US006273674B1

(12) United States Patent
Charron

(10) Patent No.: US 6,273,674 B1
(45) Date of Patent: Aug. 14, 2001

(54) WET GAS COMPRESSION DEVICE COMPRISING AN INTEGRATED COMPRESSION/SEPARATION STAGE

(75) Inventor: Yves Charron, Longpont sur Orge (FR)

(73) Assignee: Institut Francais du Petrole, Rueil-Malmaison cedex (FR)

( * ) Notice: Subject to any disclaimer, the term of this patent is extended or adjusted under 35 U.S.C. 154(b) by 0 days.

(21) Appl. No.: 09/238,588

(22) Filed: Jan. 28, 1999

(30) Foreign Application Priority Data

Jan. 28, 1998 (FR) ..... 98 00934

(51) Int. Cl.[7] ..... F04D 31/00

(52) U.S. Cl. ..... 415/169.3; 415/169.4; 415/199.1

(58) Field of Search ..... 415/169.2, 169.3, 415/169.4, 199.1, 199.2, 199.3

(56) References Cited

U.S. PATENT DOCUMENTS

| | | | | |
|---|---|---|---|---|
| 2,332,614 | * | 10/1943 | Swearingen | 415/169.2 |
| 3,104,964 | | 9/1963 | Craft . | |
| 4,059,364 | | 11/1977 | Andersen . | |
| 4,938,661 | * | 7/1990 | Kobayashi et al. | 415/199.1 |
| 4,961,260 | * | 10/1990 | Ferri et al. | 29/888.025 |
| 5,993,151 | * | 11/1999 | Paulsen et al. | 415/146 |

FOREIGN PATENT DOCUMENTS

| | | | |
|---|---|---|---|
| 235397 | | 6/1911 | (DE) . |
| 2574871 | * | 6/1986 | (FR) . |
| 2589957 | | 5/1987 | (FR) . |
| 2273958 | | 7/1994 | (GB) . |

* cited by examiner

*Primary Examiner*—Edward K. Look
*Assistant Examiner*—James M McAleenan
(74) *Attorney, Agent, or Firm*—Antonelli, Terry, Stout & Kraus, LLP

(57) ABSTRACT

A gas compression device for compressing and separating a gas including a liquid phase and a gas phase, includes at least one inlet pipe for the wet gas, at least one compressed gas outlet pipe, a shaft and several compression stages.

The device includes at least one compression stage suited for separation of the liquid phase and of the gas phase, one or more pipes designed for discharge of an essentially liquid phase resulting at least partly from the separation performed in a suitable compression stage.

The device can be used for wet gas transportation in the petroleum field.

8 Claims, 5 Drawing Sheets

WET GAS COMPRESSION DEVICE COMPRISING AN INTEGRATED COMPRESSION/SEPARATION STAGE

FIELD OF THE INVENTION

The present invention relates to a wet gas compressor comprising a first compression stage designed to prevent erosion by liquid droplets at the inlet of the impeller blades and to perform separation of the gas phase and of the liquid phase.

The compressor can comprise downstream several stages similar to the first stage or conventional impellers designed for compression of a dry gas.

The invention is intended for compression of a wet gas, i.e. a two-phase mixture whose gas and liquid volume flow rate ratio in the input conditions of the device (GLR) is higher than about 20.

The invention can find applications for production of a wet gas essentially consisting of hydrocarbons without prior gas processing, as well as in any process in the field of refining or chemistry using a gas compressor preceded by a sieve droplet separator or other.

BACKGROUND OF THE INVENTION

Various multiphase pump types allow compression of a two-phase mixture. However, rotodynamic type machines are limited to GLR ratios hardly higher than 20, and positive-displacement machines are relatively bulky for compression of a wet gas.

It is difficult to use conventional, centrifugal or axial gas compressors to compress a gaseous fluid comprising a liquid phase because of the erosion due to the liquid droplets on the blades of the impellers, of the embrittlement of the blades and of the rotor unbalance resulting therefrom.

A first primary separation stage (working under the action of the terrestrial gravity) is therefore more generally used upstream from a gas compressor for rough separation of the gas and of the liquid, then a second, secondary (for example sieve) separation stage is used for finer separation of the droplets contained in the gas. This layout also requires a single-phase pump for transfer of the liquid from the input pressure to the discharge pressure. These equipments are heavy and bulky.

The volume of the static separators can be reduced while maintaining the same degree of separation of the liquid droplets and of the gas, by generating high centrifugal forces produced only by means of the energy of the fluid (without external energy supply). This is, for example, the working principle of cyclone separators.

The volume of the separators can be reduced further yet, while maintaining the same degree of separation of the liquid droplets and of the gas, by generating very high centrifugal forces produced from an external energy (separator referred to as dynamic separator). It is for example the working principle of the dynamic separator described in the Bertin patent WO-87/03,051. While this separator has the advantage of being relatively compact, it constitutes a second rotating machine when mounted outside the compressor, and it reduces the number of impellers of the compressor by about 30% when mounted inside the compressor.

SUMMARY OF THE INVENTION

The object of the invention is a wet gas compression device that overcomes the drawbacks of the prior art and notably limits erosion caused by droplets at the stage inlet.

The wet gas compressor according to the invention comprises one or more compression stages suited to separate the liquid phase from the gas phase, to limit erosion due to droplets at the stage inlet and to compress at least the gas phase, the liquid phase being pressurized.

The invention also consists in associating a compression section suited to separate the liquid phase and the gas phase with a compression section suited for a dry gas.

The invention is intended for compression of a wet gas, i.e. a two-phase mixture whose gas and liquid volume flow rate ratio (GLR) in the input conditions of the device is higher than about 20.

What is understood to be a <<dry gas >> hereafter is a gas containing liquid droplets whose diameter is below 10 microns and consequently generating only a very low erosion at the level of the impeller blades.

The present invention relates to a wet gas compression device, said gas comprising a liquid phase and a gas phase, including:

at least one inlet pipe for said wet gas, at least one outlet pipe for the compressed gas, a shaft, several compression stages, at least one compression stage suited to limit erosion and to separate the liquid phase from the gas phase, one or more pipes designed for discharge of an essentially liquid phase resulting at least partly from the separation performed in a suitable compression stage.

The device is characterized in that the suitable compression stage comprises for example an inlet line, an impeller and an outlet line, the inlet and outlet lines allowing separation of the liquid phase and of the gas phase.

The inlet line comprises for example two substantially rectilinear and parallel walls, the walls being respectively extended by two curved walls having a radius of curvature selected to generate a centrifugal effect and the wall is provided with a means allowing passage of the liquid from the outer wall to the inner wall.

The outlet line comprises for example a return channel including at least one collecting channel, and at least one means allowing passage of the liquid into the collecting channel, the means being placed on one of the walls at the diffuser outlet.

The device can comprise an inlet line and an outlet line having the aforementioned characteristics.

At nominal delivery, the inlet angle $\alpha_2$ of the impeller blades is approximately equal to the angle $\alpha_1$ of the relative gas velocity $V_{r,g}$ and, on the other hand, the angle $\beta$ of the absolute gas velocity $V_{a,g}$, with the driving velocity $V_e$, is so determined that the relative velocity of the droplets $V_{r,l}$, is at least twice as low as that of the gas $V_{r,g}$.

At least one of the suitable compression stages can be the inlet stage of the compression device.

The device can comprise at least one means for collecting the essentially liquid phases separated in the suitable compression stage(s), the collection means being connected to the pipes designed for discharge of the essentially liquid phase and to the outlet pipe.

The present invention also relates to a wet gas compression system. It is characterized in that it comprises at least one compression device and at least one device allowing partial separation of the liquid phase, upstream from the compression device.

Using the compression device or the compression system will be advantageous for production of a wet gas in the petroleum or refining field.

The compressor according to the invention notably allows to:

- reduce the power absorbed and the number of machines in comparison with production by means of rotodynamic multiphase pumps,
- reduce the bulk and weight in comparison with production by means of positive-displacement multiphase pumps,
- reduce the number of equipments in comparison with conventional production comprising single-phase separators, compressors and pumps,
- use a larger number of compression impellers in comparison with a wet gas compressor including a dynamic separator in the compressor, as described in patent WO-87/03,051.

BRIEF DESCRIPTION OF THE DRAWINGS

Other features and advantages of the method according to the invention will be clear from reading the description hereafter of a non limitative embodiment example, with reference to the accompanying drawings wherein.

DETAILED DESCRIPTION OF THE INVENTION

Figure 1:
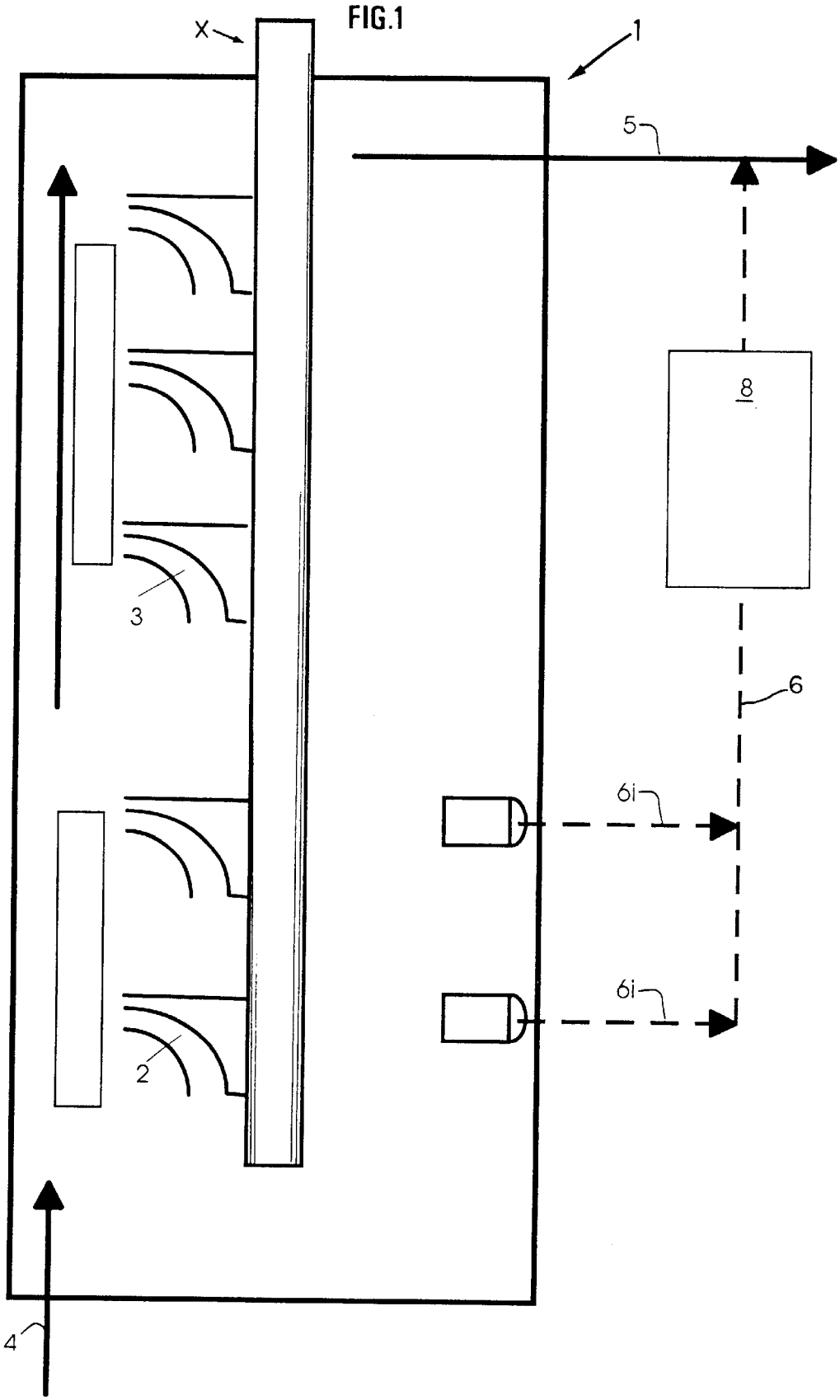
FIG. 1 schematizes the working principle of the wet gas compressor with first stages fulfilling both compression and separation functions, the next stages consisting of conventional rotor and stator elements, FIGS. 2 and 3 schematize radial and axial views of an example of a suitable stage (consisting of the stator inlet channel, an impeller and the stator outlet channel)

FIG. 1 schematizes an embodiment example of a compression device designed for wet gas or wet gas compressor.

The compression device allowing to raise the pressure of the wet gas comprises a casing 1, one or more compression stages 2 suited for a wet gas, one or more compression stages 3 suited for a dry gas, and a shaft X. The wet gas compression stages thus define a wet gas compression section followed by a dry gas compression section consisting of the dry gas compression stages.

A stage suited for wet gas compression (FIG. 2) comprises for example an inlet channel 30 comprising one or more guide blades, an impeller 35 placed downstream from the inlet line and an outlet line or stator line. The impellers are mounted on shaft X.

Wet gas compression stage(s) 2 are suited to separate the liquid phase from the gas phase and simultaneously to compress the gas phase and to pressurize the liquid phase. The inlet line and the outlet channel therefore have specific characteristics allowing to obtain the desired result, certain embodiment examples thereof being illustrated in FIGS. 2, 2A to 2D and 3.

Casing 1 is provided with several pipes allowing delivery or discharge of the various fluids as shown in FIG. 1:

- a wet gas inlet pipe 4,
- a compressed dry gas discharge pipe 5 or discharge pipe (FIGS. 1 & 5),
- a pipe 6 (FIG. 5) acting as a collector for the liquid phase separated at the level of the compression stage(s) suited for the wet gas,
- one or more pipes **6*i* for discharge of the liquid or of an essentially liquid phase separated at the level of a suited compression stage, flowing for example into collector pipe 6**.

The device is possibly provided with a pump or with an ejector 8 for transfer of the liquid phase or of the essentially liquid phase from pipe 6 to discharge pipe 5 of the compressor. An ejector is preferably used in cases where the liquid circulating in pipe 6 contains gas. A pump or an ejector can be used when the liquid circulating in pipe 6 contains no gas. The pump can be driven by shaft X of the compressor by means of a gear drive or any other means known to the man skilled in the art.

Shaft X is possibly provided with a means allowing to determine its rotating speed N.

The compressor is possibly provided with pressure detectors upstream from the inlet and downstream from the discharge end of the compressor. It can also be equipped with a means allowing to measure the flow of gas, for example located immediately downstream from the discharge end of the compressor for measurement under single-phase flow conditions.

The compressor is possibly provided with an antipumping protection known to the man skilled in the art.

The wet gas compression device can also be provided upstream with a liquid proportion measuring system so as to allow protection of the compressor in case of a sudden and considerable liquid inflow.

All the fluid transfer (pump and ejector), measuring and machine protection (antipumping, liquid proportion measurement) means are known to the man skilled in the art.

The first compression stage(s) suited for wet gas are designed so as to limit erosion on the impeller blades by the liquid droplets contained in the gas, by limiting the relative velocity of the droplets in relation to the impeller blades.

Figure 2:
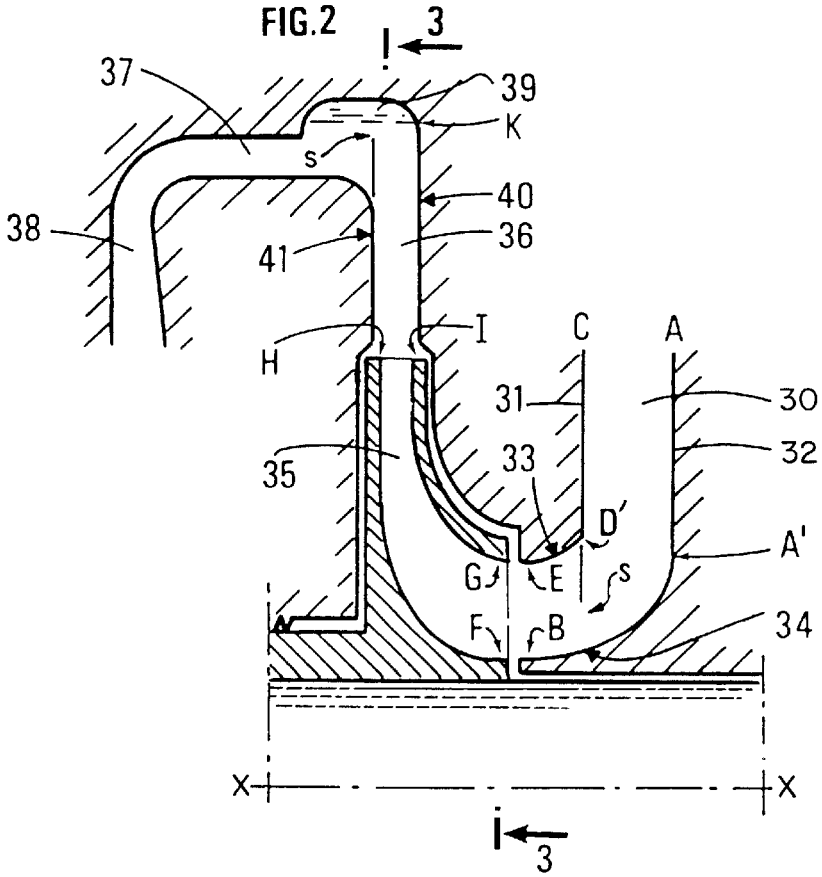
FIGS. 2A, 2B, 2C and 2D show in detail another embodiment example for the inlet and outlet channels of a stage described in FIG. 2, FIG. 4 schematizes (with a view to droplet erosion limitation) the absolute and relative velocities of the liquid and gas phases at the inlet of the first compression stage(s) also acting as a separator, FIG. 5 schematizes a valiant of FIG. 1 with, upstream, a cyclone separation system allowing to reduce the number of stages acting both as compression and separation stages.
Figure 3:
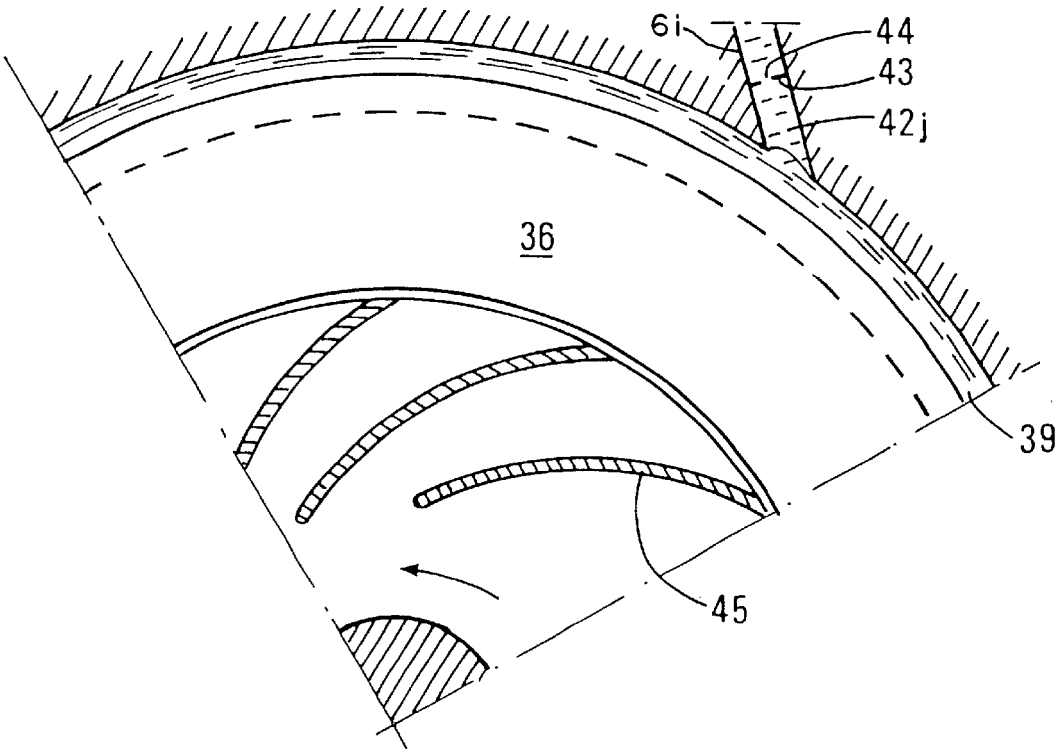
Figure 2D:
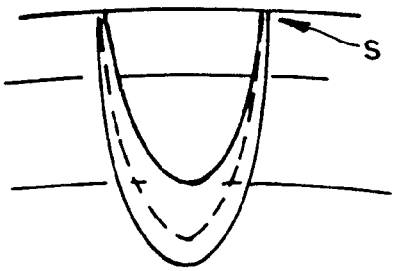
Figure 2C:
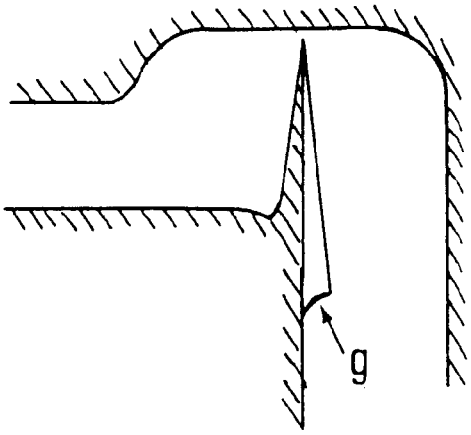
Figure 2B:
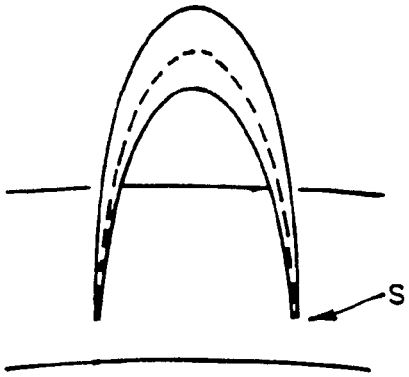
Figure 2A:
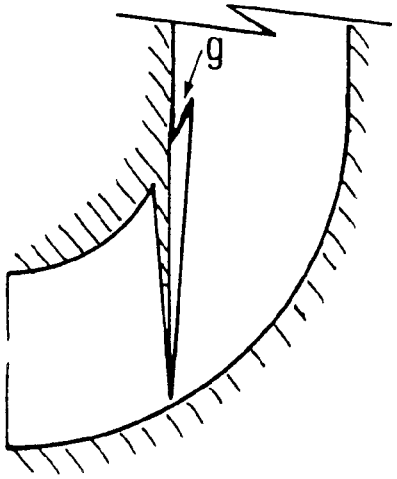

FIGS. 2 and 3 (radial section in the plane of the impeller) schematize an embodiment example of a first compression stage fulfilling simultaneously the aforementioned erosion limitation, liquid phase and gas phase separation, and compression functions. These figures show how the relative velocity of the droplets is decreased by reducing, at the impeller inlet, their distance to the axis of rotation.

The essentially gaseous fluid containing liquid droplets is fed into the first compression stage by means of inlet channel 30 (Figures) delimited by two substantially rectilinear and parallel walls 31 (C-MD), 32 (A–A'). Walls 33 (D'–E) and 34 (A'–B) form an extension of these two walls respectively. Walls 33 and 34 have a radius of curvature <<r>> selected to generate a centrifugal force that will allow separation of the liquid phase and of the gas phase. Wall 31 is provided with a means whose function is to allow passage of the liquid phase to wall 34 as described hereunder. This means can be an extension of wall 31 up to a salient point <<s>> (FIG. 2) or a gutter <<g >> (FIGS. 2A to 12D) with a shape suited for transfer of the liquid phase from outer wall 33 to inner wall 34.

In the description hereafter, the expression <<inner wall>> (34, 41) refers to the wall of the inlet channel that is closer to shaft X and <<outer wall>> (33, 40) refers to the wall that is farther from this shaft.

The wet gas flows through inlet line 30 as described hereafter.

The essentially gaseous phase containing liquid droplets is centrifuged in the curved part of the inlet line delimited by walls 33 and 34, which is contained between points A' and D' and E, B.

As a result of centrifugation, these liquid droplets settle on curved inner wall 34.

The liquid phase flowing down wall 31 in the form of a liquid film is carried along by the gas phase:

- to salient point <<s>> (FIG. 2) from which it comes off in the form of droplets prior to being transferred to wall 34, or
- in gutter <<g >> (FIGS. 2A to 2B) through which it flows onto inner wall 34.

The liquid film present on wall 34 comes off at point B as a result of the gap existing between fixed inlet channel 30 and rotating impeller 35 in the form of liquid droplets.

These droplets enter impeller 35 located downstream from the inlet channel at the point where the distance to the axis of rotation is the shortest and consequently where the peripheral speed of the impeller is the lowest.

Impeller 35 is a conventional radial impeller. During rotation, the liquid and gas phases are centrifuged from inlet FG of the impeller to inlet IH of the stator channel or outlet channel located downstream from impeller 35.

The outlet channel comprises a diffuser 36, a curved channel 37 and a return diaphragm 38.

Curved channel 37 is suited for separation of the liquid phase and of the gas phase. It comprises a collecting channel 39 and a means as described before, for example a salient point <<s>> (FIG. 2) or a gutter <<g>> (FIGS. 2C to 2D), positioned at the level of wall 41, for example at the diffuser outlet, allowing passage of the liquid phase into collecting channel 39.

The gas phase and the liquid phase flow as follows at the level of the outlet channel:

- the liquid phase dispersed in the gas phase is centrifuged at the outlet of diffuser 36 in the axial plane in the direction of collecting channel 39. As a result of the movement of the gas in the radial plane, the liquid undergoes a tangential movement in channel 39 in the direction of rotation of the impeller. This rotating movement in the axial plane allows the liquid to remain in collecting channel 39,
- the gas phase of lower density continues to flow through radial return diaphragm 38 towards the second compression stage,
- the liquid flowing partly on the walls of the diffuser:
  - for wall 40, directly after flowing down over the length thereof, and
  - for wall 41, after coming off of the liquid in the form of droplets at salient point <<s>> (FIG. 2), or after flowing through gutter <<g>> (FIGS. 2C, 2D), flows into collecting channel 39.

Collecting channel 39 is provided with one or more pipes 42*j* (FIG. 3) connected to pipe 6*i*. These pipes are for example equipped with means allowing to control the flow of liquid to be discharged, such as a plate 43 provided with one or more orifices 44. Orifices 44 are oversized so as to provide total discharge of the liquid as well as partial discharge of the gas in order to prevent obstruction of channel 37 by the liquid phase.

Such a compression stage can be designed to prevent, downstream from the stator outlet channel, carry-over of droplets with a diameter above about 10 microns and consequently to allow the use, downstream, of impellers suited for compression of a dry gas. However, a second stage similar to the first stage can be used downstream from the first so as to improve dehydration of the gas.

Figure 4:
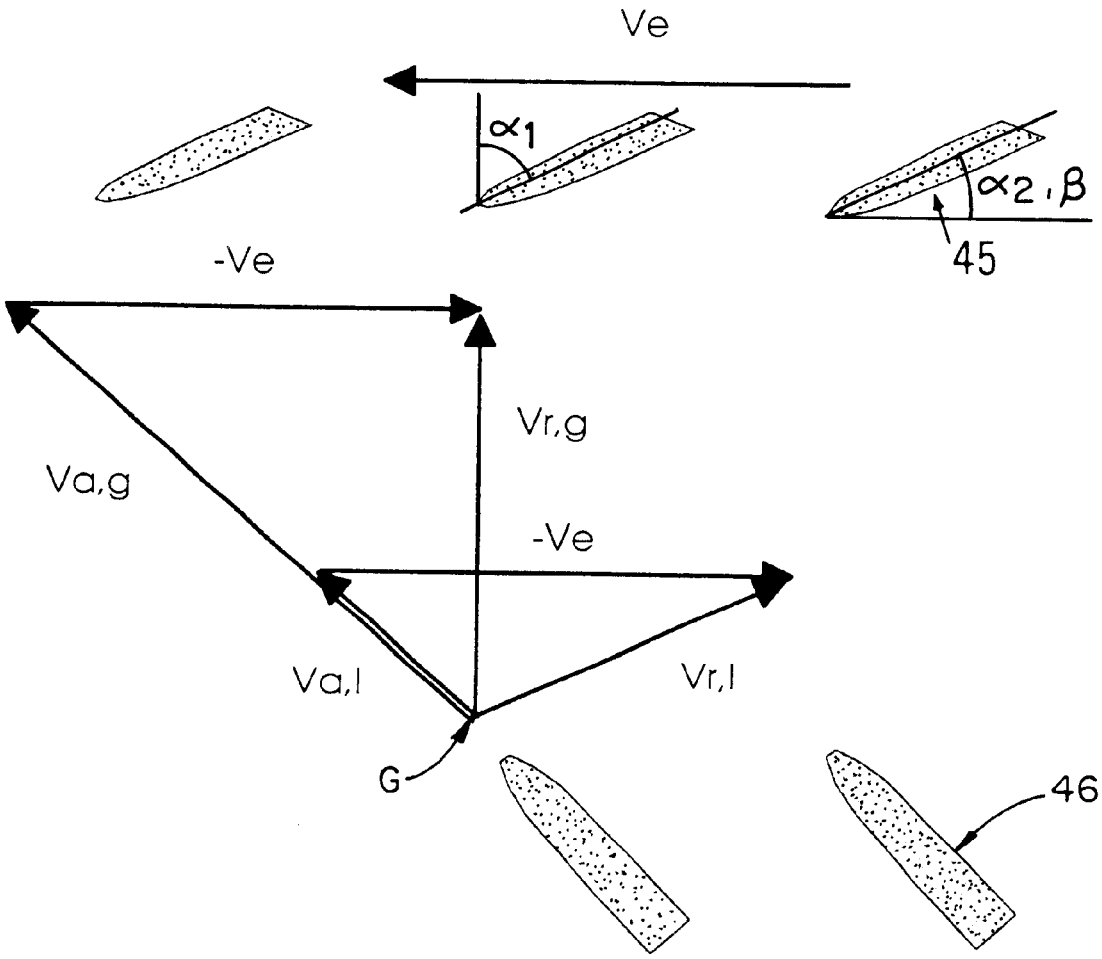

FIG. 4 shows, at point G and in the direction of the absolute velocity of the gas $V_{a,g}$, the outlet of the stator blades 46 and the inlet of the rotor blades 45 (of the impeller) of a compression stage suited for separation of the phases and for limitation of the erosion caused by the droplets at the inlet of the rotor blades.

FIG. 4 shows the triangle of velocities relative to the gas phase, at the inlet of the blades of impeller 35 at point G (FIG. 2). The inlet angle $\alpha_2$ of rotor blades 45 is so selected that the angle $\alpha_1$ of the relative velocity with the blades has a minimum value (or even zero at nominal delivery) so as to minimize incidence losses. The triangle of velocities relative to the liquid phase is not shown at point G, the most part of the liquid flowing down a cylindrical envelope of a radius corresponding to that of point F (FIG. 2).

FIG. 4 shows the triangle of velocities relative to the gas phase (solid line) and that relative to the liquid phase (dotted line), at the inlet of blades 45 of the impeller at point F (FIG. 2). The inlet angle $\beta$ of rotor blades 45 is so selected that the angle of the relative velocity with the blades has a minimum value (or zero at nominal delivery) so as to minimize incidence losses. The angle of the absolute gas velocity $V_{a,g}$ with the driving velocity $V_e$ is so selected that the relative velocity $V_{r,l}$ of the droplets is considerably lower than that of the gas, $V_{r,g}$ (by half for example). Reduction of the droplets velocity is facilitated by the driving velocity reduction at point F in relation to point G (in the ratio of the distances to the axis of rotation).

The local relative velocity $V_{r,l}$ of the droplets in relation to the impeller blades is determined by the absolute velocity $V_{a,g}$ of the gas phase, the slippage between the gas phase and the droplets, the orientation of the absolute velocity of flow and driving velocity $V_e$.

The value of the slippage between the phases can be obtained by means of correlations or more precisely from a two-phase three-dimensional calculation code, to both methods being known to the man skilled in the art.

The allowable velocity of impact of the droplets on blades 45 is determined according to the diameter of the droplets, to the material that constitutes the blades or the material deposited on the material constituting the impeller blades, and to the rate of erosion that should not be exceeded. The acceptable rate of erosion is a data that is specified according to the minimum production time and to the conditions of maintenance of the machine.

Figure 5:
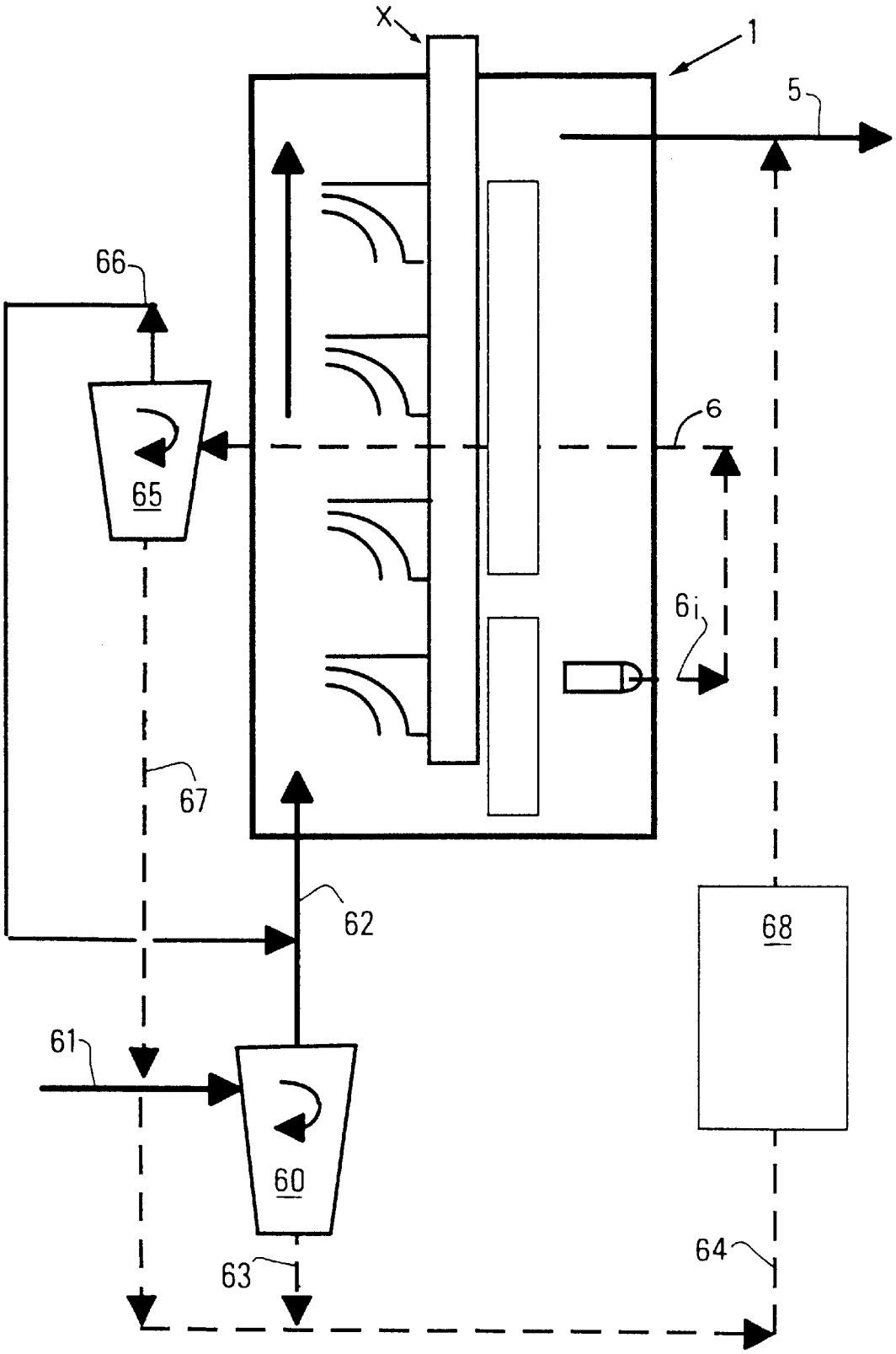

FIG. 5 shows another embodiment variant where separation is not entirely performed by the stages fulfilling both compression and separation functions, but partly upstream from the compressor with, for example, a cyclone separator 60.

In this example, the wet gas is fed into separator 60 by means of pipe 61. At the outlet of separator 60, the gas having a lesser degree of moisture than that entering pipe 61 is discharged through pipe 62 to the compressor inlet, whereas the liquid is discharged through pipe 63 to collector 64.

At the outlet of the first stage serving both as a compression and a separation stage, the mixture consisting of liquid and gas is discharged through pipe 6i to a separator 65, whereas the gas containing droplets of very small diameter is sent to the stages located downstream and suited for compression of a gas containing droplets whose diameter does not exceed 10 microns.

At the outlet of separator 65, the gas is discharged through pipe 66 at the level of pipe 62 to the compressor inlet, whereas the liquid is discharged through pipe 67 to collector 64.

The device is possibly provided with a pump or an ejector 68 allowing transfer of the liquid phase from collector 64 to discharge pipe 5 of the compressor.

Separators 60 and 65 are possibly provided with liquid level detectors, level control valves situated in pipes 67 and 63, and a level control system operating these control valves.

A comparison with multiphase pumping production is given in the tables hereunder.

The results have been obtained with the following comparison basis molecular mass of the gas: 25 compression ratio (discharge and suction pressure ratio): 3 inlet temperature: 40° C.

The tables hereunder give the number of impellers and of pump barrels required in the case of multiphase pumping production, the number of impellers and of compressors required under the above-mentioned conditions for the compression system according to the invention being 7 and 1 respectively.

Case GLR=40

| Suction pressure-MPa | 1 | 2 | 3 | 4 |
|---|---|---|---|---|
| Number of multiphase impellers | 43 | 50 | 54 | 57 |
| Number of multiphase pumps | 3 | 4 | 4 | 4 |

Case GLR=100

| Suction pressure-MPa | 1 | 2 | 3 | 4 |
|---|---|---|---|---|
| Number of multiphase impellers | 57 | 64 | 66 | 68 |
| Number of multiphase pumps | 4 | 5 | 5 | 5 |

These tables show that the number of multiphase pumps increases both with the GLR and with the suction pressure, whereas the device according to the invention to consists of a single gas compressor in the previous example.

What is claimed is:

1. A wet gas compression device, said gas comprising a liquid phase and a gas phase, including:

at least one inlet pipe for said wet gas, at least one compressed gas outlet pipe, a shaft, several compression stages, at least one of said compression stages being suited to separate the liquid phase and the gas phase, characterized in that said at least one of said compression stages comprises one or more pipes designed for discharge outside said wet gas compression device of an essentially liquid phase resulting from separation carried out in said at least one of said compression stages, an inlet channel, at least one impeller and an outlet channel, said inlet and outlet channels allowing separation of the liquid phase and of the gas phase, and said inlet channel comprises first and second substantially rectilinear and parallel walls, said first and second substantially rectilinear and parallel walls being respectively extended by first and second curved walls having a radius of curvature selected to generate a centrifugal effect, said first curved wall being further from said shaft than said second curved wall, said first curved wall and said first substantially rectilinear and parallel wall forming an outer wall of said inlet channel, and said second curved wall and said second rectilinear and parallel wall forming an inner wall of said inlet channel, and in that said first rectilinear and parallel wall is provided with means for allowing passage of the liquid from said outer wall to said inner wall.

2. A device as claimed in claim 1, characterized in that said outlet channel comprises a diffuser, a return channel including at least one collecting channel connected to said one or more pipes, and means for allowing passage of the liquid into said collecting channel, said means for allowing passage of the liquid into said collecting channel being positioned on one of the walls at the outlet of said diffuser.

3. A device as claimed in claim 1, characterized in that at least one of said suitable compression stages is the inlet stage of the compression device.

4. A device as claimed in claim 1, further comprising collecting means for collecting the essentially liquid phases separated in the suitable compression stage(s), said collecting means being connected to said pipes and to said outlet pipe.

5. A wet gas compression system comprising at least one compression device as claimed in claim 1 and at least one device allowing partial separation of the liquid phase, upstream from the compression device.

6. Use of the compression device as claimed in claim 1 for production of a wet gas in the petroleum or refining field.

7. A device as claimed in claim 1, wherein said means for allowing passage of the liquid from said outer wall to said inner wall comprises an extension of said first rectilinear and parallel wall beyond said first curved wall towards said second curved wall.

8. A device as claimed in claim 1, wherein said means for allowing passage of the liquid from said outer wall to said inner wall comprises a gutter extending from said first rectilinear and parallel wall beyond said first curved wall towards said second curved wall.

* * * * *